United States Patent [19]

Porzky

[11] Patent Number: 4,669,181

[45] Date of Patent: Jun. 2, 1987

[54] METHOD FOR MANUFACTURING AN ELECTRICAL HEATING UNIT WITH SERPENTINE HEATING ELEMENTS

[75] Inventor: Ludwig Porzky, Watertown, Wis.

[73] Assignee: General Signal Corporation, Stamford, Conn.

[21] Appl. No.: 810,995

[22] Filed: Dec. 19, 1985

Related U.S. Application Data

[62] Division of Ser. No. 608,348, May 8, 1984, Pat. No. 4,575,619.

[51] Int. Cl.[4] ..... H05B 3/64

[52] U.S. Cl. ..... 29/611; 29/848; 29/850; 264/86; 264/87; 264/272.18

[58] Field of Search ..... 29/611, 841, 848, 850; 219/345, 464, 531, 542; 264/86, 87, 272.15, 272.18

[56] References Cited

U.S. PATENT DOCUMENTS

| | | | |
|---|---|---|---|
| 940,450 | 11/1909 | Ferlà | 264/87 |
| 1,645,867 | 10/1927 | Louthan | 338/285 |
| 3,389,461 | 6/1968 | Hardardt | 29/848 |
| 3,471,680 | 10/1969 | Kelm | 219/342 |
| 3,696,507 | 10/1972 | Unger et al. | 29/611 |
| 3,952,408 | 4/1976 | Docx | 29/611 |
| 4,321,459 | 3/1982 | Miyahara et al. | 219/345 |

*Primary Examiner*—Howard N. Goldberg
*Assistant Examiner*—P. W. Echols
*Attorney, Agent, or Firm*—Burmeister, York, Palmatier, Hamby & Jones

[57] ABSTRACT

A thermal heating and insulating unit is manufactured by molding in situ a block of thermal insulating material about an electrical resistance element. The resistance element is first made from a continuous wire of electrical resistance material and formed into a serpentine configuration with a plurality of segments interconnected by bends at the ends of the segments. In a preferred construction, the segments are straight and the bends at the ends of the segments are in opposite directions. The resistance element is positioned in a mold on a plateau above a porous bottom, the bends overlapping the plateau, and a slurry of inorganic fibers, water and a binder is introduced into the mold to a lever above the plateau, the liquid component of the slurry passing through the porous bottom, and the fibers and a portion of the binder collecting on the porous bottom to form a block with a slot confronting the resistance element, the bends of the resistance element being embedded in the block. The block is then dried to produce a heating and insulating unit.

4 Claims, 7 Drawing Figures

METHOD FOR MANUFACTURING AN ELECTRICAL HEATING UNIT WITH SERPENTINE HEATING ELEMENTS

This application is a division of U.S. application Ser. No. 608,348 filed May 8, 1984, now U.S. Pat. No. 4,575,619.

BACKGROUND OF THE INVENTION

The present invention relates to electrical heating units, and to methods of manufacturing such heating units. In particular, the present invention relates to a combination thermal insulating block and one or more electrical heating elements, and to methods for manufacturing such units.

It is necessary to use some form of thermal insulating material to confine heat, particularly at elevated temperatures. In recent years, thermally insulating panels have been molded which contain lightweight ceramic fibers. Such panels are highly porous, and provide good thermal insulation at relatively low cost. U.S. Pat. No. 3,500,444 to W. J. Hesse et al describes such a panel and a filter molding process for producing such panels. In addition, the Hesse patent discloses electrical heating elements mounted on or adjacent to one of the surfaces of such a panel for use in a domestic or commercial electric range.

A helical electrical heating element partially disposed upon the surface of a panel of molded inorganic refractory fibrous material and partially embedded in the panel has not proven satisfactory for many applications, such as the walls or roof of a high temperature furnace. A helical wire heating element requires support along its length to prevent sagging, particularly at elevated temperatures. Further, the expansion and contraction rates of the heating element and the molded thermal insulating block differ, tending to cause the heating coil to break free from the block of thermal insulating material. The thermal insulating material itself has little structural strength. Accordingly, there have been extensive efforts to develop superior constructions combining electrical heating elements with such molded thermal insulating blocks.

In addition to providing mechanical support for the heating element which is effective throughout the life of the heating element, it is desirable for the heating element to be positioned to provide maximum radiation and convection heat transfer to the work load and to provide the maximum thickness of thermal insulating material between the electrical heating element and the side of the insulating block opposite the heating element. These considerations must be balanced against cost and ease of production.

A combination heating element and thermal insulating panel suitable for use in a high temperature furnace is disclosed in U.S. Pat. No. 4,278,877 to E. R. Werych. This Werych patent discloses oval elongated thermal resistance coils embedded in the panel adjacent to one surface therof with the longitudinal axes of the coils parallel to the surface. In this manner the portion of each oval coil of the heating element remote from the surface is closer to the surface than it would be were the coil cylindrical, but this remote portion of the coil nonetheless will operate at a higher temperature than the portion of the coils adjacent to the surface.

The pending United States patent application of J. Boes and L. Saris, Ser. No. 477,725, now U.S. Pat. No. 4,617,450 entitled A VACUUM FORMED ELECTRICAL HEATING DEVICE AND METHOD OF PRODUCTION discloses a similar thermal panel in which the interior region of the oval heating coils is maintained substantially free of insulating material in order to reduce the temperature of the portion of the heating coil remote from the radiating surface of the panel. In one embodiment of the Boes and Saris application, the heating coils are positioned within the block of thermal insulating material and spaced from the radiating surface of the thermal insulating material, and slots or grooves are provided between the electrical heating coils and the heat radiating surface. This construction has the advantage of retaining the heating coils more securely in the block of thermal insulating material, but still permits the radiant energy and convection from the heating coils to impinge upon the work load. However, the interior portion of the oval heating elements do operate at a higher temperature than the portion of the heating elements adjacent to the radiating surface of the block, thus reducing the capacity and efficiency of the heating panel.

Resistance elements in the form of a rod of resistance material bent in a series of reverse spaced bends to form a flat element are common in the electric furnace art, and such elements have also been mounted on molded ceramic fiber insulating panels. U.S. Pat. No. 4,403,329 of E. R. Werych entitled SUPPORT SYSTEM FOR ELECTRICAL RESISTANCE ELEMENT discloses a pin for insertion in such ceramic fiber panels provided with a clip for engaging one of the bends of such a serpentine resistance element. U.S. Pat. No. 4,299,364 of P. J. Loniello entitled INSULATING MODULE INCLUDING A HEATER ELEMENT SUPPORT also discloses a rod molded in the insulating panel and extending therefrom, the rod being provided with keeper pins for retaining the electrical heating elements adjacent to the surface of the thermal insulating panel. While such mounting devices position the heating element to utilize the radiant and convection heat transfer produced by the heating element, and permit the thermal insulating block to provide substantially maximum thermal insulation, they are costly and require considerable hand assembly work in construction. In addition, the movable parts of such hangers and mounting structures tend to fail under severe use conditions.

SUMMARY OF THE INVENTION

It is an object of the present invention to provide a combination thermal insulating block and electrical heating element in which the heating element is mounted near the surface of the thermal insulating block, that is, without use of mounting brackets, and in which more of the heat produced by the heating element is transferred to the work load by radiation and convection than in such prior constructions. It is a further object of the present invention to provide a combination thermal insulating block and electrical heating element in which the electrical heating element is mounted near the surface of the block and in which the temperature difference between the hottest portion of the heating element and the coolest portion of the heating element is substantially lower than in such prior constructions.

It is also an object of the present invention to provide a method for producing thermally insulated heating panels with one or more electrical heating elements mounted near the surface of a thermal insulating block having the properties set forth above by a casting or molding process.

In accordance with the present invention a block of thermal insulating material containing inorganic fibrous material is provided with an elongated slot which extends into the block forming opposed walls on opposite sides of the axis of the slot. A heating element in the form of elongated serpentine wire with opposed bends on opposite sides of the axis of the wire is disposed in the slot with the bends on one side engaging one wall of the slot and the bends on the other side engaging the other wall of the slot. In a preferred construction, the walls of the slot are parallel, and the bends on one side are spaced from the bends on the other side by relatively straight portions of the electrical resistance wire, the straight portions being approximately parallel to each other and of equal length.

In another embodiment of the present invention, the portions of the resistance wire between the bends of opposite direction are not straight, but bow toward the heat radiating surface of the block.

In accordance with the present invention, the thermal insulating block is molded or cast with one or more slots or grooves, and an electrical heating element is molded in situ to each groove to form a thermally insulated heating panel. The electrical heating element may be formed in a number of different ways, and in a preferred process is formed of resistance wire by bending the wire at a plurality of locations along the length of the wire, each successive bend being in the opposite direction. The heating element is placed on a portion of the bottom of a frame which is raised above the adjacent portions of the bottom to form a plateau, one side of the heating element overlapping one side of the plateau and the opposite side of the heating element overlapping the opposite side of the plateau. Thereafter, a slurry containing inorganic fibers and a liquid is introduced into the frame, and the liquid removed to deposit the fibers on the bottom of the frame. The frame may contain a plurality of slots or grooves in the insulating block. A separate heating element is then placed on each plateau and a plurality of slots, each containing an electrical resistance element, is molded in situ in a single operation. Preferably, the bottom of the frame is porous, permitting the liquid to drain from the frame, thus facilitating deposit of the inorganic fibers on the bottom of the frame. The block thus formed is removed from the frame and dried.

Other and further objects and advantages of the present invention will be understood by reference to the following specification in conjunction with the annexed drawings, wherein like parts have been given like numbers.

DESCRIPTION OF PREFERRED EMBODIMENTS

Figure 1:
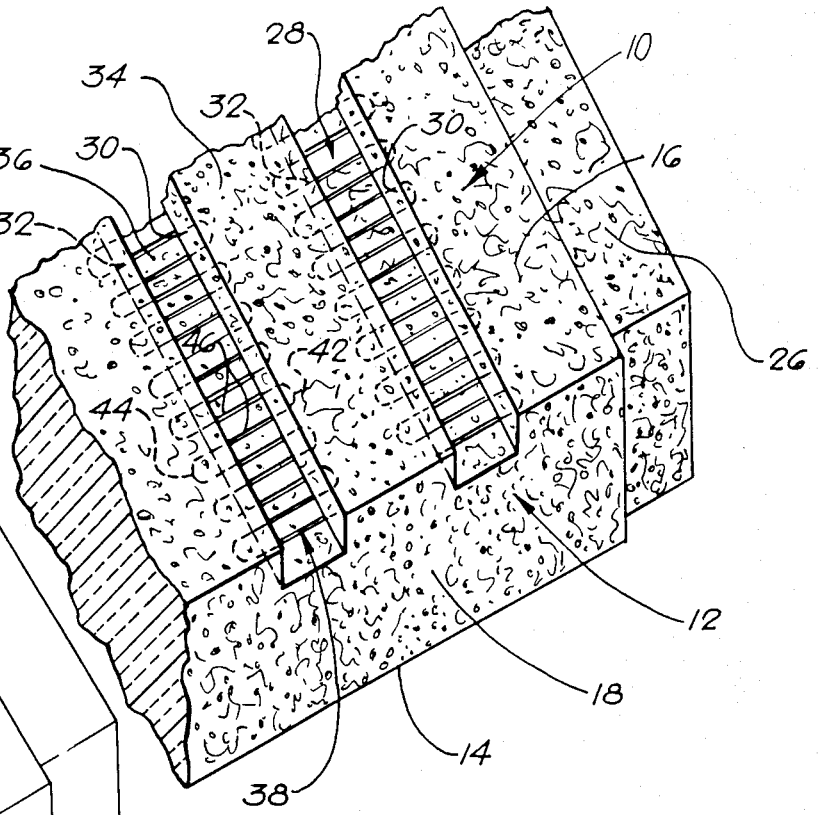
FIG. 1 is a fragmentary isometric view of a combination electrical heating element and thermal insulating panel constructed according to the present invention.
Figure 2:
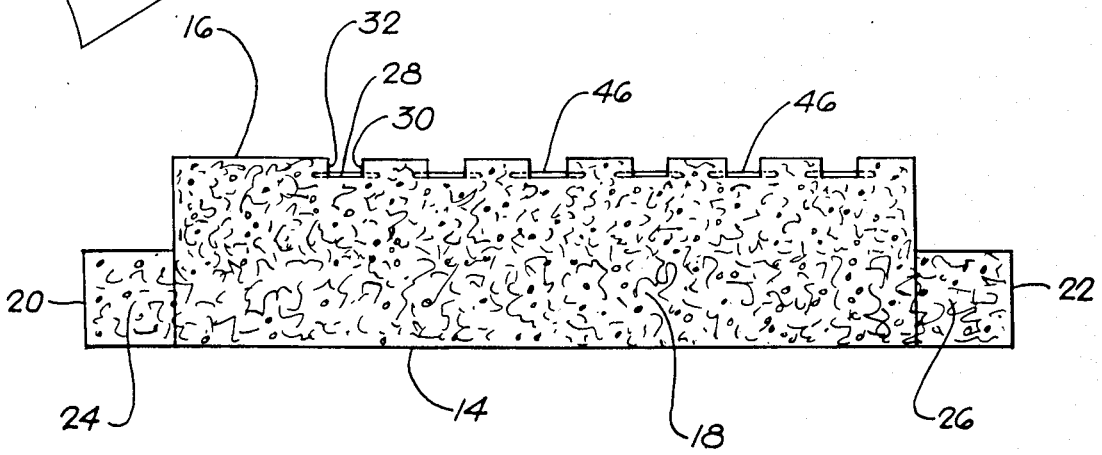
FIG. 2 is a front elevational view of the panel of FIG. 1.

An electrical heating unit, or panel 10 embodying the present invention is illustrated in FIGS. 1 and 2. The panel has a molded block 12 of thermal insulating material. The block is preferably molded of inorganic ceramic fibers of the type disclosed in U.S. Pat. No. 3,500,444. In such a block, high refractory compositions, such as silica or quartz, magnesia, alumina-silica, and some other materials, produce inorganic fibers which exhibit resistance to deterioration at temperatures up to the order of 2,500° F. Blocks made of such compositions are relatively porous and provide excellent thermal insulation. Further, such blocks are readily molded into various shapes and are thus particularly suitable for forming the walls of a furnace, such as disclosed in U.S. Pat. No. 4,246,852 of Ewald R. Werych entitled INDUSTRIAL FURNACE WITH CERAMIC INSULATING MODULES.

The block 12 has two flat parallel surfaces 14 and 16, a face 18 extending between the surfaces 14 and 16, sides 20 and 22, and a back, not shown. The sides 20 and 22 can be provided with outwardly extending steps 24 and 26 which are adapted to mate with the recesses in other panels to form a closed furnace.

Figure 1A:
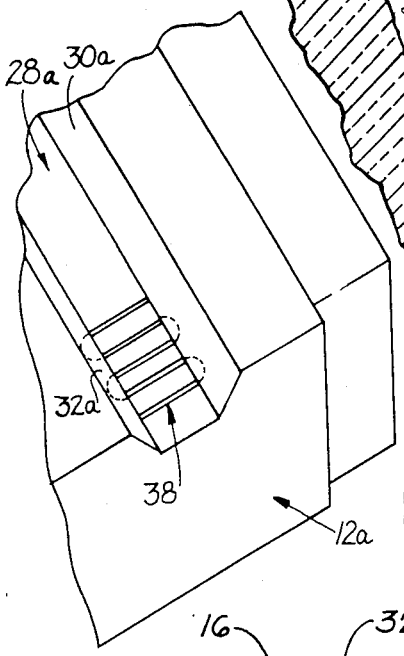
FIG. 1*a* is a fragmentary isometric view of an alternative construction to the construction of FIG. 1.

The block 12 is provided with a plurality of slots or grooves 28 which extend into the surface 16 of the block 12, the grooves 28 being elongated and having parallel walls 30 and 32, as illustrated in FIG. 1. In the modified construction of FIG. 1*a*, grooves 28*a* in block 12*a* have oblique opposed walls 30*a* and 32*a*. Adjacent grooves 28 are spaced by strips 34 and are parallel to each other. Each of the grooves 28 extends into the block 12 from the flat surface 16 essentially the same distance and forms a flat surface or land 36 which is engaged by a serpentine heating element 38.

Figure 3:
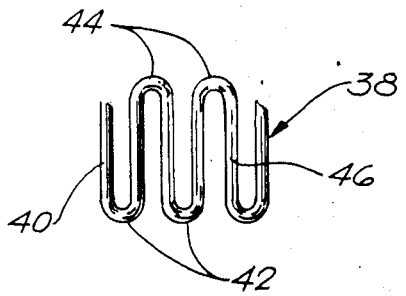
FIG. 3 is a plan view of one of the heating elements shown in FIGS. 1 and 2.

The heating element 38 is an elongated electrical resistance wire 40 with two groups of bends 42 and 44. The bends 42 are separated from each other by a fixed distance along the axis of the wire 40, and the bends 44 are separated from each other by the same fixed distance. The bends 44 are each located essentially between bends 42 of the resistance wire, except for the last bend at each end of the wire. Each of the bends 42 and 44 have approximately the same radius of curvature, and each bend 42 is separated from the bends 44 by straight sections 46 of the resistance element. The connecting sections 46 are of equal length, thereby positioning the bends 42 on an axis which is parallel to an axis through the bends 44. Each of the bends 42 and 44 encompass an angle of 180° in the preferred construction illustrated in FIG. 3, and therefore, the straight sections 46 are parallel to each other. As a result of this construction, the heating element 38 approaches the maximum mass of heating element per unit of length for a given diameter wire 40 and for bends 42 and 44 of a given radius of curvature. The invention may be practiced however using bends 42 and 44 of less than 180°, and the sections between each bend 42 and 44 may be curved as will be hereinafter described. The wire 40 as illustrated in FIG. 3 is cylindrical in shape, but the wire may be flat, square, rectangular or the like.

Each of the heating elements 38 is disposed in one of the grooves 28 in abutment with the land 36 thereof. The straight sections 46 of the resistance elements 38 extend through the walls 30 and 32, and the bends 42 and 44 are embedded in the strips 34 between adjacent grooves 28. The heating element 28 is retained in assembly with the block 12 due to the engagement of the fibers of the block 12 with the bends 42 and 44 of the heating element 38.

As illustrated In FIG. 1, a portion of the connecting sections 46 of the heating elements 38 can be embedded in the strips 34 of the block 12. For best heat transfer, the bends 42 and 44 should merely abut the walls 30 and 32 of the grooves 28, but such a construction may not adequately attach the heating elements 38 to the block 12. The block 12 has little strength, and the heating element may exhibit considerable mass. Hence, it is generally necessary to at least partially embed the bends 42 and 44 into the strips 34. The depth of penetration of the bends 42 and 44 into the strips 34 changes upon heating of the resistance element 38. Expansion of the heating element 38 occurs along the entire axis of the element, but expansion of the connecting sections 46 force the bends 42 and 44 against the fibers of the block 12, thereby causing the bends to further penetrate the strips 34. The block 12 however has little shear strength, and the expansion of the resistance element produces a compressional force against the block 12 which significantly aids in retaining the heating element 38 in attachment to the block 12, particularly at elevated temperatures. Each of the bends 42 and 44 is embedded into one of the strips 34 by a distance generally no greater than one-fourth of the distance between the bends 42 and the bends 44, so that at least one-half of the resistance element 38 as measured between the bends 42 and 44 is disposed on the land 36.

Adjacent grooves 28 must be separated by sufficient distance so that the strip formed between the grooves provides adequate electrical insulation between adjacent electrical heating elements 38. The ceramic fibrous material of the block 12 is an electrical insulator, but the electrical insulating properties depend to some extent upon the specific materials used in the block and the associated environment and temperature in which it is used. Adjacent grooves 28 must be separated sufficiently to provide adequate electrical insulation for the application.

In one preferred construction, six grooves 28 are disposed in the flat surface of a block 12, each groove extending completely from the front surface 18 of the block to the back surface to a depth of $\frac{1}{4}$ inch. Each groove has a width measured perpendicular to the walls 30 and 32 of $\frac{5}{8}$ inch. The electrical resistance heating element 38 is constructed of 15 gauge Kanthal A-1 heating element wire with a cylindrical cross section and a resistance of 0.127 ohms per inch. The outer edges of the bends 42 are disposed on an axis displaced from the outer edges of the bends 44 by a distance of $\frac{7}{8}$ inch, and hence approximately 3/16 inch of each bend 42 and 44 is embedded in the block 12.

Figure 5:
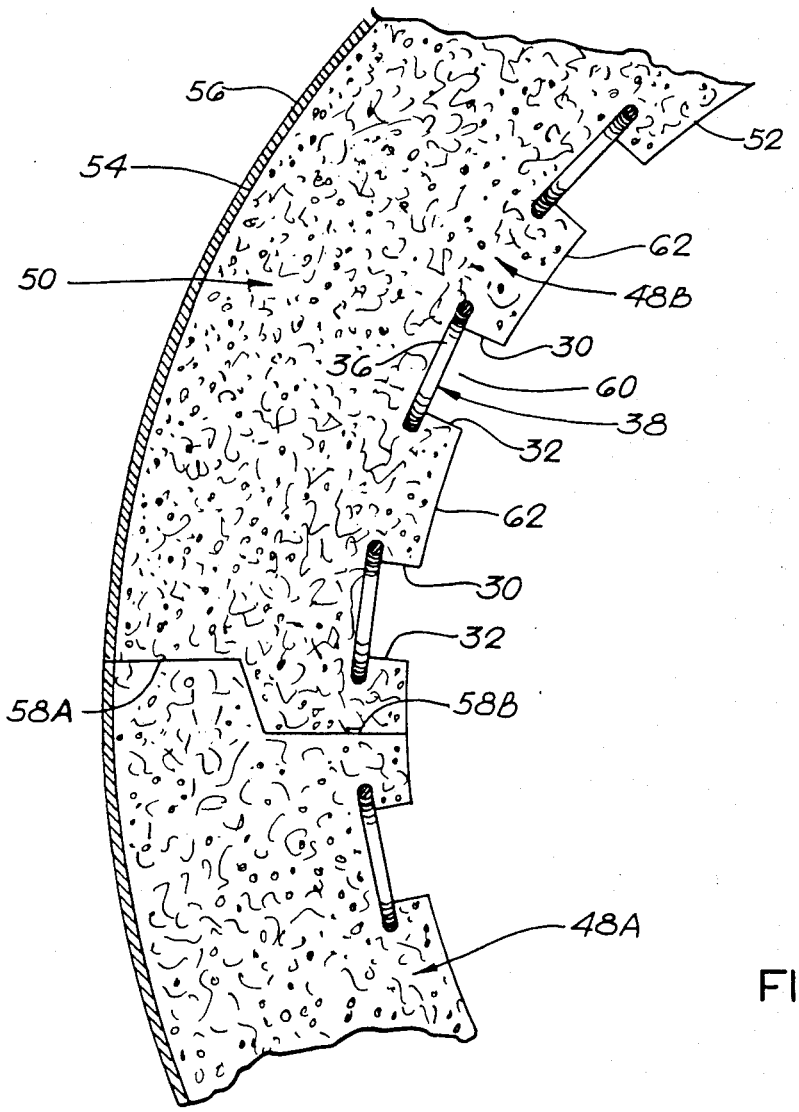
FIG. 5 is a fragmentary sectional view of a combination heating element and thermally insulated panel for use in a cylindrical furnace.

The panel illustrated in FIGS. 1 and 2 is adapted to be incorporated with other panels to form a square or rectangular furnace, and the panels are adapted to be operated at temperatures up to approximately 2,500° F. FIG. 5 illustrates two interconnected panels 48A and 48B which form a fragment of a cylindrical furnace. Each of the panels 48A and 48B have a block 50 of thermal insulating material of the type described above with reference to the block 12. The block 50 has a cylindrical inner surface 52 and a cylindrical outer surface 54. The outer surface can be provided with a protective and abrasion resistant metal covering 56. It will be noted that the panel 48A and the panel 48B can be provided with mating stepped surfaces 58A and 58B to form a continuous cylinder as illustrated in FIG. 5.

Each block 50 is provided with a plurality of spaced slots 60 which extend normal to a plane tangent to the inner cylindrical surface and are otherwise identical to the slots 28 of the embodiment of FIGS. 1 and 2, the same reference numerals being used to identify identical portions of the slots 28 and 60. The slots 60 have lands 36 extending between walls 30 and 32, and the walls are separated by ribs 62. Electrical resistance heating elements 38, identical to the heating elements of the embodiment of FIGS. 1 and 2, are disposed upon the lands 36 and extend through the walls 30 and 32 into the ribs 62.

Figure 6:
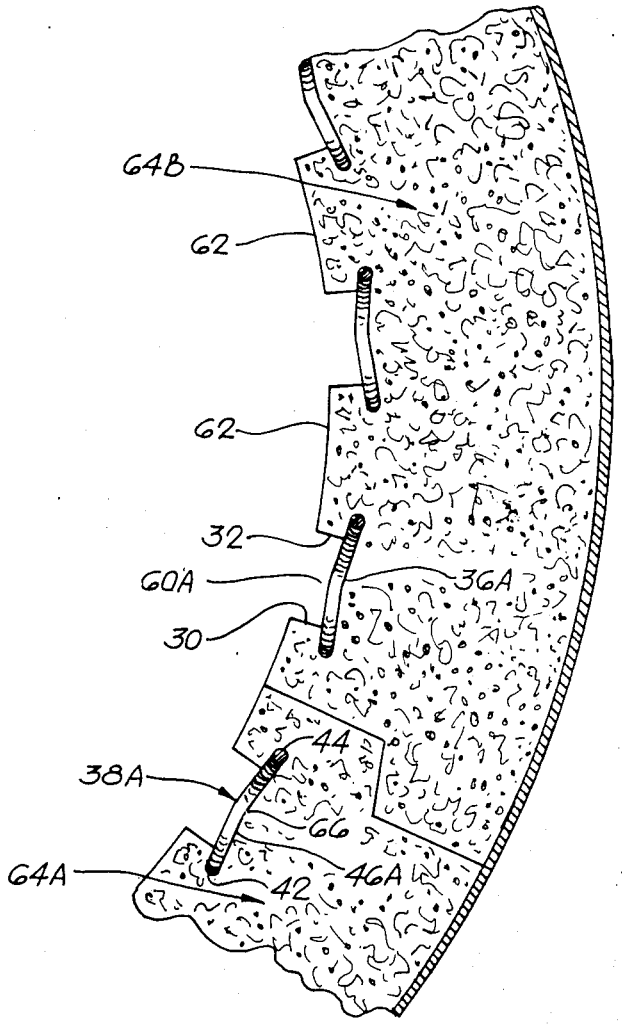
FIG. 6 is a fragmentary sectional view, on a similar plane to FIG. 5, of a combination heating element and thermal insulating panel for use in a cylindrical furnace utilizing a modified serpentine heating element.

The embodiment of FIG. 6 is a modification of the embodiment of FIG. 5, and illustrates two panels 64A and 64B mounted together to form a cylindrical furnace which are identical to the panels 48A and 48B except the lands 36A of the slots 60A differ in that the lands 36A curve toward the heated surface.

In like manner, a modified resistance heating element 38A is disposed in each of the slots 60A in abutment with the land 36A thereof. The resistance heating element is identical to the heating element of FIG. 3, except the heating element of FIG. 6 has interconnecting sections 46A between the bends 42 and 44 provided with a curve extending from one bend 42 to the other bend 44, the curves being aligned to match the protrusion 66 of the land 36A.

The use of a transversely curved heating element, as illustrated in FIG. 6, has the advantage of being able to accommodate the linear expansion of the wire heating element without placing undue force on the material of the thermal insulating block of the panels 64A and 64B. Expansion of the wire of the resistance element 38A will be divided between compression of the material in the block of the panel 64A or 64B and curvature of the resistance element 38A itself.

Figure 4:
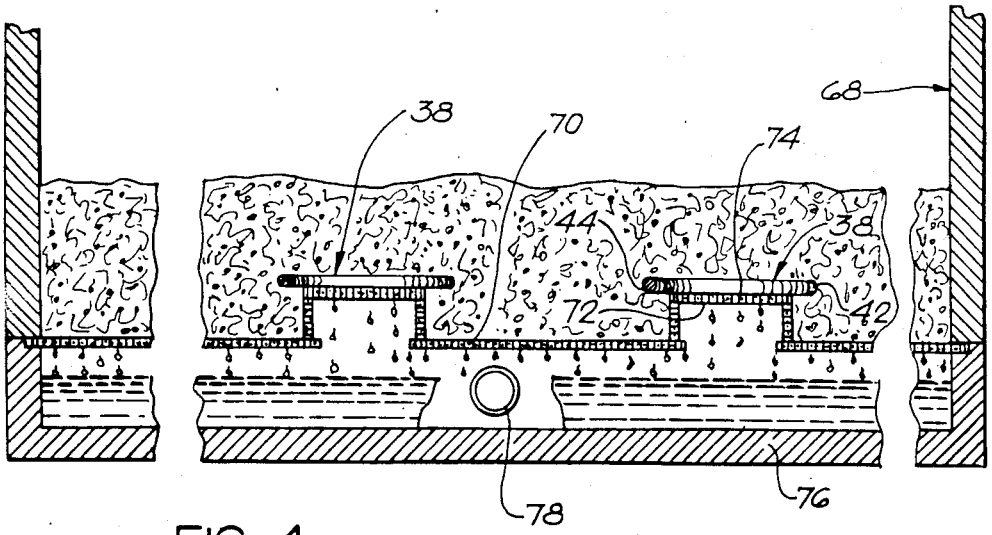
FIG. 4 is a diagrammatic view of processing equipment for producing the panel of FIGS. 1 through 3.

FIG. 4 illustrates, somewhat diagrammatically, a possible apparatus for producing the panels of FIGS. 1 and 2. FIG. 4 illustrates a frame which is provided with a horizontal bottom 70. The bottom 70 supports a plurality of elongated upwardly rising plateaus 72. Each of the plateaus has a flat rectangular upper member 74. The bottom 70, entire plateaus 72 and upper member 74 are of porous material.

Frame 68 is mounted on a suction box 76 which extends below the bottom 70 of the frame. The suction box 76 has an orifice 78 which is adpated to be connected to a means, not shown, to evacuate the suction box 76.

In practice, a resistance heating element 38 is placed on each plateau 74, with the bends 42 and 44 overlapping opposite sides of the plateau. With the heating elements thusly positioned, and held into position by means not shown, the frame 68 is filled to a level above the resistance elements 38 with a slurry of water, binder, and inorganic fibers of the type described in U.S. Pat. No. 3,500,444 of W. K. Hesse et al. The liquid portion of the slurry is permitted to flow through the bottom 70 of the frame 68, and suction is used to withdraw the liquid portion of the slurry, thereby depositing the inorganic fibrous portion on the bottom 70. Further, the porous plateau 72 permits the passage of the liquid portion of the slurry, and the fibers will be deposited upon the resistance heating element 38 and the walls of the plateau. It will be noted in FIG. 4 that a plurality of plateaus 72 are employed to mold in situ a plurality of electrical heating elements 38. The block thus formed is thereafter removed from the frame 68 and dried.

Curved electrical heating elements, such as the elements 38A of the embodiment of FIG. 6 can be produced in a modified form of the production equipment of FIG. 4. To produce such elements, the upper member 74 of the plateau 72 must be curved to the contour of the heating element 38A.

Those skilled in the art will devise many uses for the present invention beyond those here disclosed. Further, those skilled in the art will devise modifications of the heating panels here disclosed within the scope of the present invention. For example, the present invention may be practiced with the heating elements using resistance wire in which the relatively straight portions between the first group of bends and the second group of bends are not parallel to each other, or may not be of equal lengths. It is therefore intended that the scope of the present invention be not limited by the foregoing disclosure but rather only by the appended claims.

The invention claimed is:

1. A method of making a combination heating and thermal insulating panel in situ comprising forming an elongated heating element having a resistance member with a plurality of bends located along the length of the element, each bend being in a common plane, successive bends being in opposite directions to form a serpentine member, placing said heating element on an elongated plateau extending from the bottom of a frame, the bottom of the frame being porous, said heating element overlapping the plateau and being suspended above the bottom of the frame, thereafter introducing a slurry of ceramic fibers, a binder, and water into the frame, thereafter withdrawing the liquid component of the slurry from the frame, the liquid component of said slurry passing through the porous bottom of the frame and depositing the major portion of the ceramic fibers and a portion of the binder and water on the bottom to form a solid body, the body surrounding the heating element and having a slot extending therein to the heating element, removing the body from the frame, and drying the body.

2. The method of making a combination heating and thermal insulating panel in situ comprising the steps of claim 1 wherein a plurality of elongated heating elements are positioned on a plurality of parallel elongated plateaus extending from the porous bottom of the frame, each heating element overlapping the plateau and being suspended above the bottom of the frame.

3. The method of making a combination heating and thermal insulating panel in situ comprising the steps of claim 1 wherein the porous bottom of the frame is disposed above and sealed upon a vacuum box, in combination with the step of applying suction to the vacuum box and withdrawing the liquid component of the slurry from the vacuum box.

4. The method of making a combination heating and thermal insulating panel in situ comprising forming an elongated electrical heating element in the form of a resistance wire with a plurality of bends located along the length of the wire, each bend being in a common plane with successive bends being in opposite directions to form a serpentine member, placing said serpentine member on an elongated plateau extending from the bottom of a mold, said serpentine member overlapping the plateau and the bends of the serpentine member being suspended above the bottom of the mold, thereafter introducing a slurry of hydraulic setting cement and water into the mold, retaining the slurry in the mold for a sufficient period of time to harden into a cast body, and removing the cast body from the mold.

* * * * *